US011434616B1

(12) United States Patent
Anderson

(10) Patent No.: US 11,434,616 B1
(45) Date of Patent: Sep. 6, 2022

(54) EROSION BLOCK

(71) Applicant: Robert Anderson, North Yarmouth, ME (US)

(72) Inventor: Robert Anderson, North Yarmouth, ME (US)

( * ) Notice: Subject to any disclaimer, the term of this patent is extended or adjusted under 35 U.S.C. 154(b) by 2 days.

(21) Appl. No.: 17/127,170

(22) Filed: Dec. 18, 2020

Related U.S. Application Data

(60) Provisional application No. 62/950,427, filed on Dec. 19, 2019.

(51) Int. Cl.
*E02D 17/20* (2006.01)
*E02B 3/12* (2006.01)

(52) U.S. Cl.
CPC .... *E02D 17/205* (2013.01); *E02D 2200/1642* (2013.01); *E02D 2220/00* (2013.01); *E02D 2300/0051* (2013.01); *E02D 2300/0085* (2013.01); *E02D 2600/30* (2013.01)

(58) Field of Classification Search
CPC ... E02D 17/205; E02D 29/0208; E02B 3/125; E02B 3/127
See application file for complete search history.

(56) References Cited

U.S. PATENT DOCUMENTS

| | | | | |
|---|---|---|---|---|
| 2010/0064627 | A1* | 3/2010 | Heselden | E02B 3/124 52/745.09 |
| 2014/0154018 | A1 | 6/2014 | Singleton | |
| 2015/0132069 | A1 | 5/2015 | Taylor | |
| 2019/0075738 | A1* | 3/2019 | Manning | A01G 24/50 |

FOREIGN PATENT DOCUMENTS

| | | | |
|---|---|---|---|
| CN | 1480590 | A | 3/2004 |
| CN | 104429528 | A | 3/2015 |
| CN | 104499475 | A | 4/2015 |
| CN | 105400159 | A | 3/2016 |
| CN | 105568953 | A | 5/2016 |
| CN | 105735233 | A | 7/2016 |
| CN | 105839611 | A | 8/2016 |
| CN | 106192895 | A | 12/2016 |
| CN | CN-106759397 | A | 5/2017 |
| CN | 107165152 | A | 9/2017 |
| CN | 107268570 | A | 10/2017 |
| CN | 107268571 | A | 10/2017 |
| CN | 107401174 | A | 11/2017 |
| CN | 107806080 | A | 3/2018 |
| CN | 108018846 | A | 5/2018 |
| CN | 108696172 | A | 10/2018 |
| CN | 108914881 | A | 11/2018 |
| CN | 109024530 | A | 12/2018 |
| CN | 109295823 | A | 2/2019 |

(Continued)

*Primary Examiner* — Benjamin F Fiorello
*Assistant Examiner* — Stacy N Lawson
(74) *Attorney, Agent, or Firm* — Moser Taboada

(57) ABSTRACT

Provided is an erosion control kit (ECK) comprising: (I) an erosion control block comprising: (a) a degradable box-shaped frame of latticed ligament with a top, bottom and four sides; (b) a degradable fabric framed just inside the top, bottom and four sides of the frame and defining an interior space; and (c) soil substantially filling the interior space; and (II) one or more anchors configured to bind a bottom portion of the frame to a substratum. Related erosion control features and methods are further provided.

20 Claims, 5 Drawing Sheets

(56) References Cited

FOREIGN PATENT DOCUMENTS

| | | | | |
|---|---|---|---|---|
| CN | 109383053 | A | | 2/2019 |
| CN | 109457685 | A | | 3/2019 |
| CN | 109469040 | A | | 3/2019 |
| CN | 109487776 | A | | 3/2019 |
| CN | 109518675 | A | | 3/2019 |
| GB | 2129015 | A | | 5/1984 |
| KR | 100243394 | B1 | | 3/2000 |
| KR | 20010056657 | A | | 7/2001 |
| KR | 200378312 | Y1 | | 3/2005 |
| KR | 200408102 | Y1 | * | 2/2006 |
| KR | 200410693 | Y1 | * | 3/2006 |
| KR | 200415273 | Y1 | * | 5/2006 |
| KR | 20080110352 | A | | 12/2008 |
| KR | 20100067565 | A | * | 6/2010 |
| KR | 20110035453 | A | * | 4/2011 |
| KR | 20160012650 | A | | 2/2016 |
| KR | 20170105952 | A | | 9/2017 |
| KR | 20170129430 | A | | 11/2017 |

* cited by examiner

EROSION BLOCK

CROSS-REFERENCE TO RELATED APPLICATION

This application claims benefit of U.S. Provisional Patent Application No. 62/950,427 filed Dec. 19, 2019, which is hereby incorporated in its entirety.

The present application relates generally to erosion control blocks framed with erodible material.

Eroding land for example on hills or shorelines is aesthetically displeasing, can threaten to undermine constructions, and reduces the ability of the land to support vegetative matter. Remediating such erosion is difficult because the eroded land may no longer be supportive of growing plants that could help resist further erosion. Added soil will be subject to the same erosive forces as caused the original problem, and is likely even more prone to erosion as it will be less fixed to the land than the original soil. Thus, a system to stabilize soil and plants for a period of years, such as five years, is needed. A system that so stabilizes and then blends into the natural background is still more needed.

SUMMARY

Provided is an erosion control kit (ECK) comprising: (I) an erosion control block comprising: (a) a degradable box-shaped frame of latticed ligament with a top, bottom and four sides (b) a degradable fabric framed just inside the top, bottom and four sides of the frame and defining an interior space; and (c) soil substantially filling the interior space; and (II) one or more anchors configured to bind a bottom portion of the frame to a substratum. Related erosion control features and methods are further provided.

For example, also provided is an erosion control terrain (ECT) comprising: (1) two or more erosion control kits of an ECK embodiment that comprise erosion control blocks; and (2) optionally one or more additional said erosion control blocks, wherein the erosion control blocks are joined together to form a terrain that covers about 100 ft2 or more, with some ECBs joined to others at each of their lateral sides.

DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments.

Figure 1:
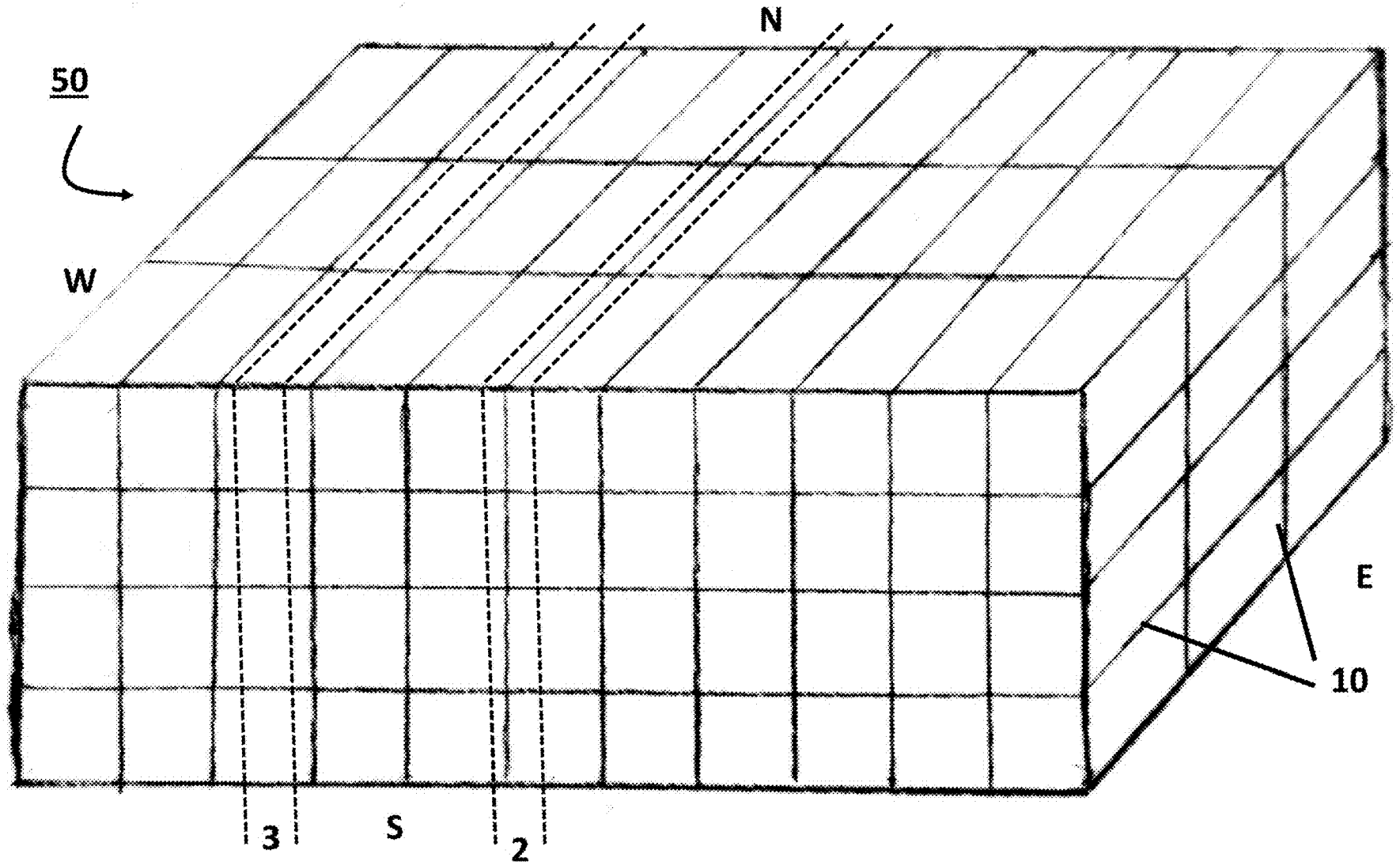
FIG. 1 shows a ligament frame that can be used to form an ECB of the invention.

To facilitate understanding, identical reference numerals have been used, where possible, to designate comparable elements that are common to the figures. The figures are not drawn to scale and may be simplified for clarity. It is contemplated that elements and features of one embodiment may be beneficially incorporated in other embodiments without further recitation.

DETAILED DESCRIPTION

The ECB is formed of latticed ligament. "Ligament" means any wire/rope/chain/fastener/ligament that is longer than it is wide such that a lattice structure can define a such a block. The ECB has length and width dimensions that are 1 foot or more, such as about 2 feet by about 4 feet. ECB height can be for example about 1 foot to about 2 feed. "Latticed" means that the ligament forms an intersecting pattern.

The ECB is generally box-shaped. Those of skill will recognize that a structure of latticed ligament filled with soil will generally not have perfectly linear sides.

The ligament in all or in the upper portions of the ECB is configured to erode away with a target of a few years. In use, several ECBs will be secured together in both dimensions. The goal of ligament erosion is to not for a substantial lattice above the ground after 5, 6, 7, 8, 9, 10, 15, 20, 30 or 40 years. In embodiments, the ligament is selected to be expected to have lost strength and be dispersed by foot traffic (and thus lack substantial lattice structure) in about 5, 6, 7, 8, 9, 10, 15, 20, 30 or 40 years if in a temperate zone with about 40 inches or more of precipitation. As mentioned, the so selected ligament can be used in the upper portions of the ECB, and may or may not be used in lower portions.

FIG. 1 shows a ligament frame 50 formed of ligaments 10. Though the edge ligaments are shown in thicker lines, this is merely an option. Shown for reference are the lateral sides labeled E, W, N, S.

Figure 2:
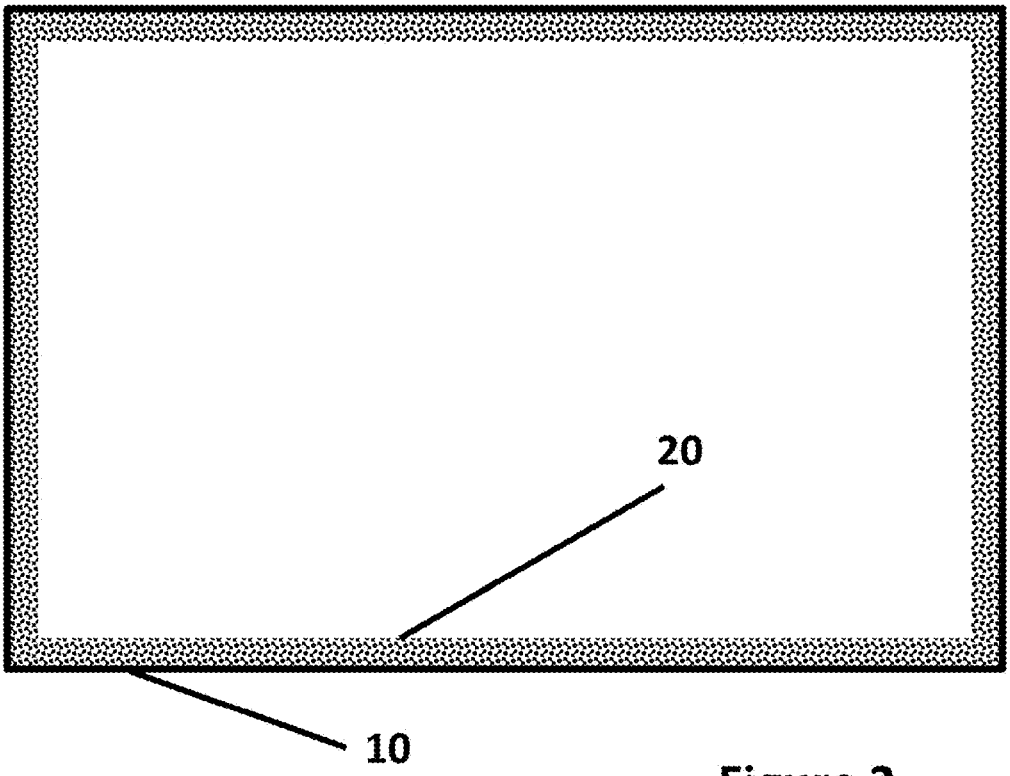
FIG. 2 depicts a cut-away of a portion of an ECB.

FIG. 1 does not show the degradable fabric 20 of the ECB, which is shown in the cutaway of FIG. 2. FIG. 2 is the cut-away portion of the ligament frame marked 2 and indicated by the dashed lines in FIG. 1, except with the degradable fabric added. The degradable fabric 20 is situated next to the ligament lattice on all six sides of the ECB. The degradable fabric 20 can be periodically affixed to the ligaments 10.

Figure 3:
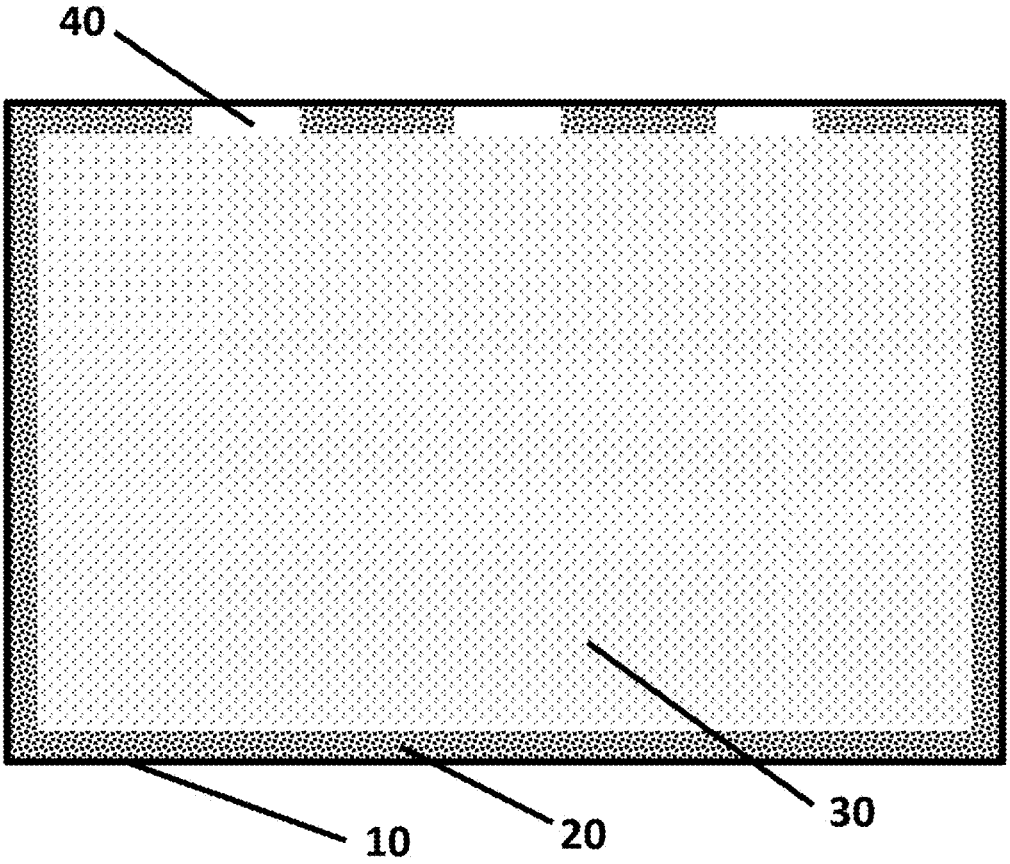
FIG. 3 shows a cut-away of a portion of an ECB.
Figure 4:
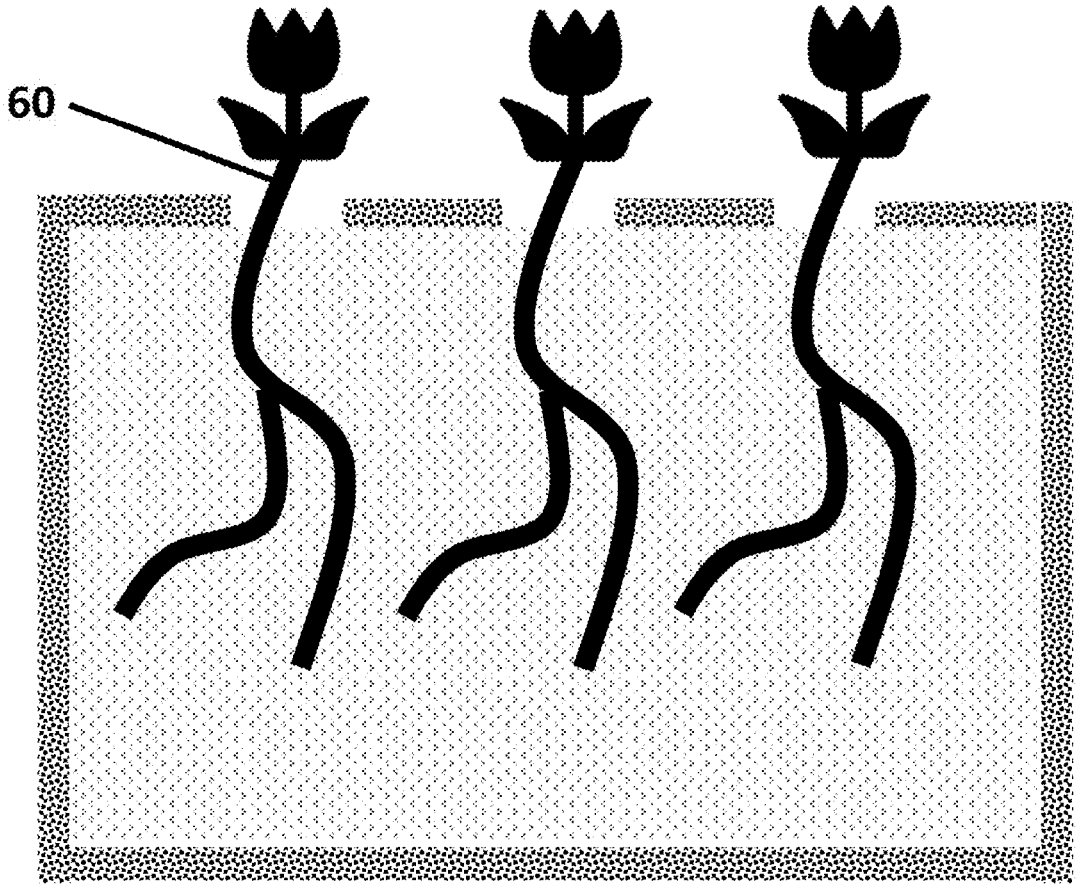
FIG. 4 shows a cut-away of an ECB.

FIG. 3 shows another cut-away of an ECB, at the location marked 3 in FIG. 1. FIG. 3 shows a further feature of the ECB, namely the soil 30. Also show in cross-section are the holes in the fabric 40 for facilitating the early growth of a rooted plant. Plants 60 are shown in FIG. 4.

Figure 5:
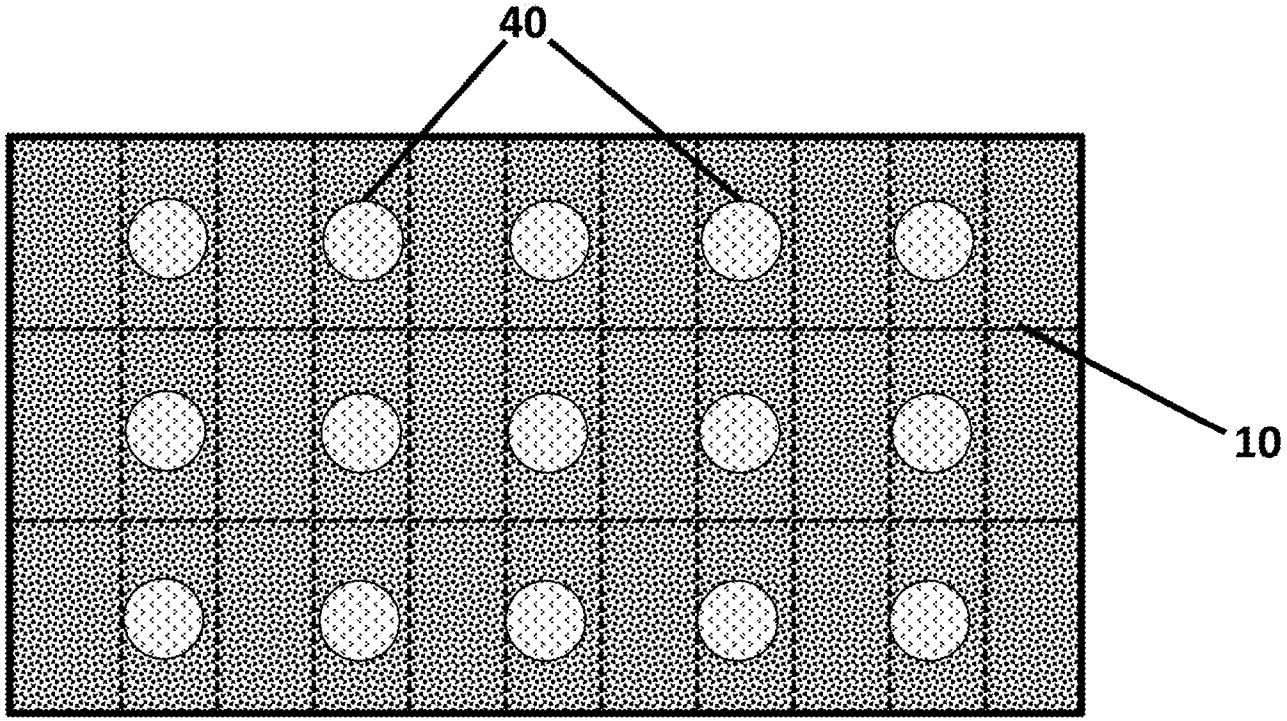
FIG. 5 shows a top view of an ECB.

FIG. 5 shows a top surface of an ECB embodiment. Through the holes 40, the soil 30 can be seen (by texture, un-numbered in the figure for clarity).

Figure 6:
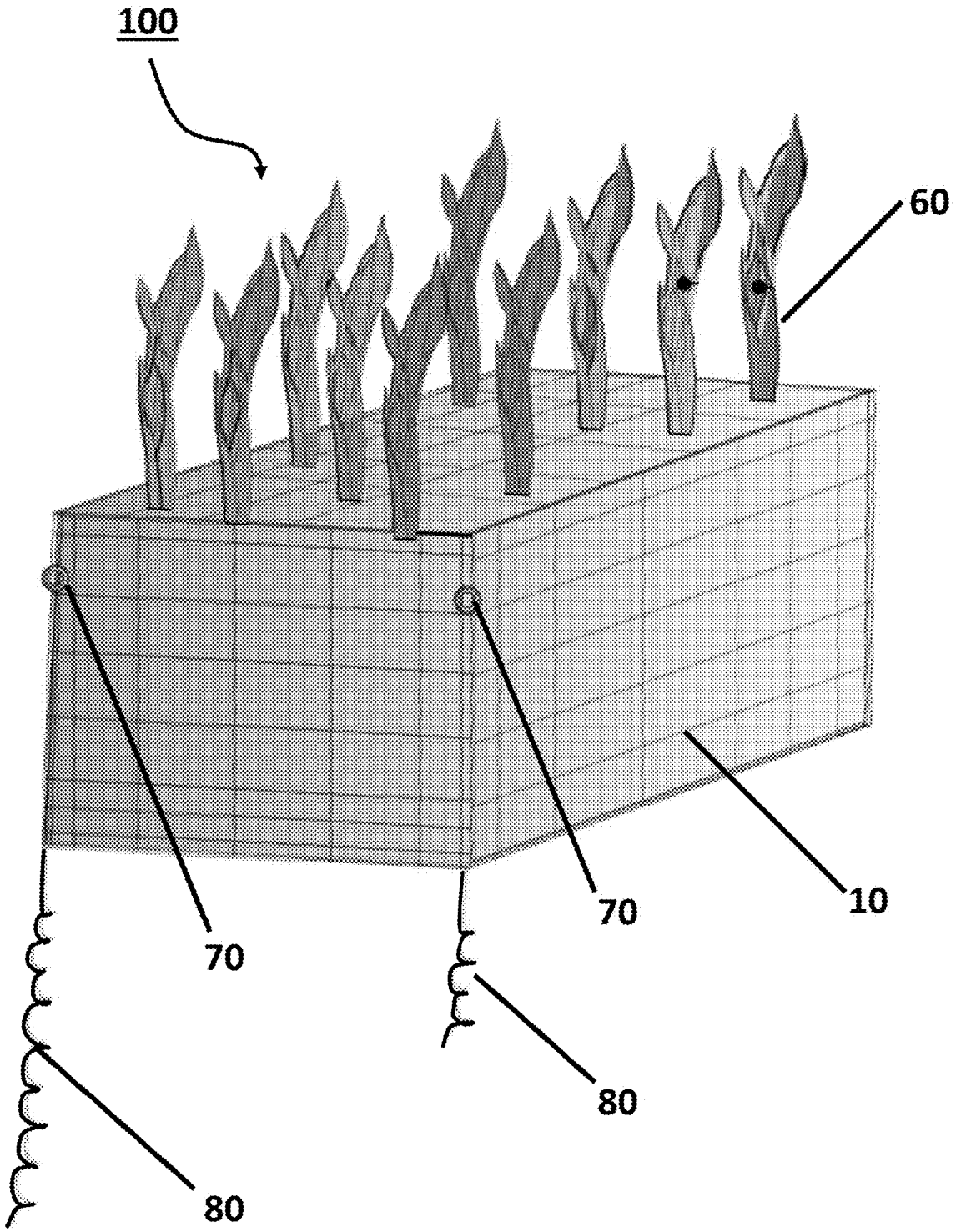
FIG. 6 shows a perspective view of an ECB.

FIG. 6 shows a more complete image of an ECB 100. This embodiment contains attachment hardware 70, which are rings or clips or the like for securing one ECB to another. Rings can be used with ligament (the same or different from the lattice of the ECB) to tie ECBs together, or as attachment points for clips attached from adjacent ECBs. Also shown are anchors 80. In place or in supplement to rings or clips, wire coils can be used to join ECBs. Such wire coils can be degradable, or designated for removal once a terrain of ECBs has stabilized.

In embodiments, the width of the ECB is from about 1 ft to about 4 ft, such as about 1.5 ft to about 2.5 ft. In embodiments, the length of the ECB is from about 2 ft to about 6 ft, such as about 3.5 ft to about 4.5 ft. In embodiments, the height of the ECB is from about 0.6 ft to about 3 ft, such as about 1 ft to about 2 ft. In embodiments, the weight of the ECB is configured to be readily conveyed from a flatbed truck with forklift configured to mount on the back of the flatbed. In embodiments, the weight of the ECB is about 2,000 lbs. or less, such as from about 400 lbs. to about 1,500 lbs.

While ligaments 10 are shown on the edge boundaries of the ECBs, in embodiments they are located off all or some of the edge boundaries. In embodiments, the ligaments are attached at all or a subset of lattice junctions. Attachment can be for example with ties (e.g. with ligament), with welding (of metal or polymer), with knots, or the like. The ligament can be woven in whole or in part, such that the frame can be tightened on its internal components by drawing one of the ligaments. Woven ligaments can also adjust to shifts in the internal components.

Ligament can be rope, such as rope of hemp, coconut fiber, silk, corn fiber, cotton, sisal, manila, other natural fibers, or the like. A portion of a stronger polymer or fiber, such as silk, can be blended into a rope that is primarily other fibers to provide greater strength. Ligament can be metal, such as galvanized steel, or polymer-coated metal such as powder-coated metal. Ligament can be single strand or multi-strand polymer, so long as the polymer contains sufficient degradable polymer as to satisfy the degradability requirement. Such degradable polymers include without limitation polyesters such as polyhydroxyalkanoates (PHA), polylactic acid (PLA), polyglycolic acid (PGA), polybutylene succinate (PBS), polycaprolactone (PCL) and polybutylene adipate terephthalate (PBAT). Other polymers, including polymers with amide linkages, can provide useful degradability. Polyvinyl alcohol (PVA) has biodegradability, though it may need to be a lesser component. When polymer-coated metal is used, the polymer can include an appropriate amount of degradable polymer. If longer ligament erosion times are sought, one of skill can make appropriate choices, such as galvanized steel or larger size diameter or rubberized stainless steel.

The degradable fabric can be for example a coconut fabric. Other options include without limitation palm fiber fabric, hemp fabric, silk fabric, corn fiber fabric, cotton fabric, sisal fabric, manila fabric, and other natural fiber fabrics. In embodiments, the degradable fabric can for example have a thickness of about ⅛ inch to about ¾ inch, or about 3/16 inch to about ½ inch. Thickness can add dimensional stability to the ECB. The degradable fabric can have a longer life than the life of the degradable portion of the ligament.

The fabric can be permeable. Permeability allows water to percolate through the ECB. At the same time, the fabric's permeability should not be too high, so that the fabric helps retain moisture.

In embodiments, the fabric just inside the top of the frame is thinner than the fabric elsewhere.

The erosion control blocks can be sold or distributed in a kit (erosion control kit, ECK) with soil anchors. The anchors can be anchored in the ground and attached to an ECB with wire, clips or the like. The anchors and their attachment hardware need not have the degradation requirements of needed for the top of the ECB, since it will generally be 0.6 ft or more underground.

Anchors can be used on each ECB, or on a useful subset thereof. ECBs with anchors can include anchors at each lower corner, or a subset. Suitable anchors include ductile anchors, screw anchors, or the like. Ductile anchors include wedge-shaped plates with a hinged connection to the anchored device on the plate, and a removable guide connector for fitting a guide rod. The guide rod directs the wedge side into the ground. Once the guide rod is removed, pulling on the hinged connection rotates the wedge to resist further upward motion.

The soil used in the ECB can be an organic grow mix, potting soil, top soil or the like. The soil can contain plant growth mixtures, fertilizers, and the like.

The ECBs can be used to create terrains (erosion control terrains, ECTs) on eroded land. As such they are joined in a tile pattern extending in both lateral dimensions. As such, in embodiments they cover about 100 $ft^2$ or more (or about 150 $ft^2$ or more, or about 200 $ft^2$ or more, or about 300 $ft^2$ or more, or about 400 $ft^2$ or more), with some ECBs joined to others at each of their E, W, N and S sides.

In embodiments of building terrains, soil can be packed against the edges of the ECBs to join the grades of the natural and ECB terrains. Fabric can be placed over that soil to stabilize. The fabric can have holes used for plantings as described for the ECBs. The fabric can be attached to adjacent ECBs.

Specific embodiments according to the methods of the present invention will now be described in the following examples. The examples are illustrative only, and are not intended to limit the remainder of the disclosure in any way.

All ranges recited herein include ranges therebetween, and can be inclusive or exclusive of the endpoints. Optional included ranges are from integer values therebetween (or inclusive of one original endpoint), at the order of magnitude recited or the next smaller order of magnitude. For example, if the lower range value is 0.2, optional included endpoints can be 0.3, 0.4, . . . 1.1, 1.2, and the like, as well as 1, 2, 3 and the like; if the higher range is 8, optional included endpoints can be 7, 6, and the like, as well as 7.9, 7.8, and the like. One-sided boundaries, such as 3 or more, similarly include consistent boundaries (or ranges) starting at integer values at the recited order of magnitude or one lower. For example, 3 or more includes 4 or more, or 3.1 or more. If there are two ranges mentioned, such as about 1 to 10 and about 2 to 5, those of skill will recognize that the implied ranges of 1 to 5 and 2 to 10 are within the invention.

A laminate is a bonding, fusing, adhesion, or the like between polymer layers, or between polymer and fabric layers, such that in the range of anticipated use the laminate is a unitary structure.

Where a sentence states that its subject is found in embodiments, or in certain embodiments, or in the like, it is applicable to any embodiment in which the subject matter can be logically applied.

This invention described herein is of an ECB, bed of ECBs and methods of forming the same. Although some embodiments have been discussed above, other implementations and applications are also within the scope of the following claims. Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims. More specifically, those of skill will recognize that any embodiment described herein that those of skill would recognize could advantageously have a sub-feature of another embodiment, is described as having that sub-feature Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority is also incorporated by reference herein in the manner described above for publications and references.

The invention is further described with reference to the following numbered embodiments.

Embodiment 1. A erosion control kit (ECK) comprising: (a) an erosion control block comprising: (1) a degradable box-shaped frame of latticed ligament with a top, bottom and four sides; (2) a degradable fabric framed just inside the top, bottom and four sides of the frame and defining an interior space; and (3) soil substantially filling the interior space; and (b) one or more anchors configured to bind a bottom portion of the frame to a substratum.

Embodiment 2. The erosion control kit of an ECK embodiment, wherein the weight of the erosion control block is configured to be about 2,000 pounds or less Embodiment 3. The erosion control kit of an ECK embodiment, wherein the degradable fabric just inside the top of the frame has a pattern of holes configured to allow the placement of plants rooted in the soil.

Embodiment 4. The ECK of embodiment 3, further comprising plants extending through the holes and rooted in the soil.

Embodiment 5. The ECK of embodiment 3, further comprising seeds planted in the soil and configured to sprout through the holes.

Embodiment 6. The erosion control kit of an ECK embodiment, wherein the ligament comprises wire or rope.

Embodiment 7. The erosion control kit of an ECK embodiment, wherein the ligament comprises natural fiber.

Embodiment 8. The erosion control kit of an ECK embodiment, wherein the ligament on the top of the frame is selected to erode to lack substantial lattice structure after about 10 years.

Embodiment 9. The erosion control kit of an ECK embodiment, wherein the ligament on the top of the frame is selected to erode to lack substantial lattice structure after about 5 years.

Embodiment 10. The erosion control kit of an ECK embodiment, wherein the fabric is a coconut fabric mat.

Embodiment 11. The erosion control kit of an ECK embodiment, further comprising attachment hardware at a corner of the frame, and at an opposing corner of the frame.

Embodiment 12. The erosion control kit of an ECK embodiment, wherein the anchor is a screw anchor or a ductile anchor.

Embodiment 13. The erosion control kit of an ECK embodiment, further comprising seeds planted in the soil and configured to sprout through the degradable fabric just inside the top of the frame.

Embodiment 14. A erosion control terrain (ECT) comprising: (a) two or more erosion control kits of an ECK embodiment that comprise erosion control blocks; and (b) optionally one or more additional said erosion control blocks, wherein the erosion control blocks are joined together to form a terrain that covers about 100 ft2 or more, with some ECBs joined to others at each of their lateral sides, optionally wherein the ECT comprises one or more erosion control kits of an ECK embodiment.

Embodiment 15. The erosion control terrain of an ECT embodiment, wherein the erosion control blocks are joined together to form a terrain that covers about 150 ft2 or more.

Embodiment 16. The erosion control terrain of an ECT embodiment, wherein the erosion control blocks are joined together to form a terrain that covers about 200 ft2 or more.

Embodiment 17. The erosion control terrain of an ECT embodiment, wherein the erosion control blocks are joined together to form a terrain that covers about 300 ft2 or more.

Embodiment 18. The erosion control terrain of an ECT embodiment, wherein the erosion control blocks are joined together to form a terrain that covers about 400 ft2 or more.

Embodiment 19. The erosion control terrain of an ECT embodiment, wherein one or more edges of the terrain are landscaped with soil covered with fabric to match the grade of the erosion control terrain to surrounding terrain.

Embodiment 20. A method of soil erosion control comprising forming a erosion control terrain of an ECT embodiment on eroded soil.

Embodiment 21. The method of embodiment 20 comprising: (a) arranging the erosion control blocks in a tile pattern on the eroded soil; (b) adhering erosion control blocks to their neighbors; and (c) anchoring some or all the erosion control blocks to the eroded soil so as to stabilize the erosion control blocks from shifting.

What is claimed is:

1. An erosion control kit (ECK) comprising:

an erosion control block comprising:

a degradable box-shaped frame of latticed ligament with a top, bottom and four sides, wherein degradability of the latticed ligament varies based on location of the latticed ligament on the frame;

a degradable fabric framed inside the top, bottom and four sides of the frame and defining an interior space; and soil substantially filling the interior space; and one or more anchors configured to bind a bottom portion of the frame to a substratum.

2. The erosion control kit of claim 1, wherein a weight of the erosion control block is configured to be about 2,000 pounds or less.

3. The erosion control kit of claim 1, wherein the degradable fabric inside the top of the frame has a pattern of holes configured to allow placement of plants rooted in the soil.

4. The erosion control kit of claim 3, further comprising plants extending through the holes and rooted in the soil, or seeds planted in the soil and configured to sprout through the holes.

5. The erosion control kit of claim 1, wherein the ligament comprises wire or rope.

6. The erosion control kit of claim 5, wherein the ligament comprises natural fiber.

7. The erosion control kit of claim 1, wherein the ligament at the top of the frame is selected to erode to lack lattice structure after about 10 years.

8. The erosion control kit of claim 1, wherein the ligament at the top of the frame is selected to erode to lack lattice structure after about 5 years.

9. The erosion control kit of claim 1, wherein the fabric is a coconut fabric mat.

10. The erosion control kit of claim 1, further comprising attachment hardware at a corner of the frame, and at an opposing corner of the frame.

11. The erosion control kit of claim 1, wherein the one or more anchors is a screw anchor or a ductile anchor.

12. The erosion control kit of claim 1, further comprising seeds planted in the soil and configured to sprout through the degradable fabric inside the top of the frame.

13. An erosion control terrain (ECT) kit comprising:

two or more of the erosion control kits of claim 1 that each comprise the erosion control block; and wherein the erosion control blocks are configured to be joined together to form a terrain that covers about 100 $ft^2$ or more.

14. The erosion control terrain kit of claim 13, wherein the terrain covers about 150 $ft^2$ or more.

15. The erosion control terrain kit of claim 13, wherein the terrain covers about 200 $ft^2$ or more.

16. The erosion control terrain kit of claim 13, wherein the terrain covers about 300 $ft^2$ or more.

17. The erosion control terrain kit of claim 13, wherein the terrain covers about 400 $ft^2$ or more.

18. The erosion control terrain kit of claim 13, wherein one or more edges of the terrain are configured to be landscaped with soil covered with fabric to match a grade of the erosion control terrain to surrounding terrain.

19. A method of soil erosion control comprising forming the erosion control terrain of claim 13 on eroded soil.

20. The method of claim 19, wherein forming the erosion control terrain includes:

arranging the erosion control blocks on the eroded soil;

adhering the erosion control blocks together; and anchoring one or more of the erosion control blocks to the eroded soil to stabilize the erosion control blocks from shifting.

* * * * *